US008690485B2

(12) United States Patent
Smith et al.

(10) Patent No.: US 8,690,485 B2
(45) Date of Patent: Apr. 8, 2014

(54) ROCK BOLT SEALING SYSTEM

(76) Inventors: Eric W. Smith, Mars, PA (US); Homer D. Libengood, Blairsville, PA (US)

( * ) Notice: Subject to any disclaimer, the term of this patent is extended or adjusted under 35 U.S.C. 154(b) by 45 days.

(21) Appl. No.: 13/607,684

(22) Filed: Sep. 8, 2012

(65) Prior Publication Data

US 2013/0236251 A1 Sep. 12, 2013

Related U.S. Application Data

(60) Provisional application No. 61/548,572, filed on Oct. 18, 2011.

(51) Int. Cl.
*E21D 20/02* (2006.01)

(52) U.S. Cl.
USPC ..... 405/259.6; 405/259.5

(58) Field of Classification Search
USPC ..... 405/259.1, 259.3, 259.5, 259.6
See application file for complete search history.

(56) References Cited

U.S. PATENT DOCUMENTS

| | | | | | |
|---|---|---|---|---|---|
| 4,338,048 | A * | 7/1982 | Murphy et al. | ..... | 405/259.6 |
| 4,352,693 | A * | 10/1982 | Langdon | ..... | 405/259.5 |
| 4,395,162 | A * | 7/1983 | Murphy et al. | ..... | 405/259.6 |
| 4,528,792 | A * | 7/1985 | Cross et al. | ..... | 405/259.6 |
| 4,537,535 | A | 8/1985 | MacBain | | |
| 4,894,269 | A * | 1/1990 | Kimura | ..... | 405/259.6 |
| 5,249,898 | A | 10/1993 | Stepanski et al. | | |
| 5,282,697 | A * | 2/1994 | Maechtle | ..... | 405/259.6 |
| 5,387,060 | A | 2/1995 | Locotos | | |
| 5,544,981 | A * | 8/1996 | Nishida et al. | ..... | 405/259.6 |
| 5,763,026 | A * | 6/1998 | Makino et al. | ..... | 405/259.6 |
| 6,135,674 | A | 10/2000 | Neilson | | |
| 6,747,068 | B2 | 6/2004 | Kelly | | |
| 6,955,277 | B2 | 10/2005 | Smith et al. | | |
| 7,073,981 | B2 | 7/2006 | Wilson et al. | | |
| 7,073,982 | B2 | 7/2006 | Stankus et al. | | |
| 7,338,234 | B2 | 3/2008 | Rataj et al. | | |
| 2004/0161316 | A1 | 8/2004 | Locotos et al. | | |
| 2012/0243946 | A1 * | 9/2012 | Simmons et al. | ..... | 405/259.6 |

* cited by examiner

*Primary Examiner* — Frederick L Lagman
(74) *Attorney, Agent, or Firm* — Gerald K. White

(57) ABSTRACT

The present invention is directed to sealable rock bolts that prevent water leakage through the bolt, a kit containing portions of such bolts prior to assembly, installation, and use, and a method of using such sealable rock bolts. Such rock bolts are fastened in place in a roof, wall, or bottom of an underground region via pressure fitting or the like. The rock bolt contains a sealing unit that contains a liquid water activated, expandable hydrophobic pre-polymeric resin. The sealing unit has side, top, and bottom portions that are degradable by water to permit the resin to expand upon contact with water and to seal the bolt to prevent water passage through the bolt.

18 Claims, 5 Drawing Sheets

ROCK BOLT SEALING SYSTEM

This patent application claims priority under 35 U.S.C. 119(e) from U.S. provisional patent application Ser. No. 61/548,572 filed Oct. 18, 2011, entitled Rock Bolt Sealing System, and incorporated herein by reference in its entirety.

FIELD OF INVENTION

The present invention is directed to a technique and system for sealing rock bolts to prevent the leakage of water or other liquids after the rock bolt has been set in to place in the roof or wall of a mine, karst zone, or other underground structure. The invention also pertains to a sealable rock bolt, a rock bolt kit useful in the practice of the invention and a sealing unit to be inserted into the rock bolt to cause sealing.

BACKGROUND OF THE INVENTION

Rock bolts, sometimes referred to as friction rock stabilizers, are support mechanisms designed to be placed into a drilled hole or opening in the roof, side, or bottom of an underground structure where such bolts are anchored and sometimes tensioned to support the overlying structure or external utilities, such as pipes or mesh. Rock bolts are commonly used in applications involving mining, rail, road and sewer tunnels, rail and road cut throughs, soil nails for hillside supports, hydro electric flumes, and karst zones. Rock bolts are commonly used in or around any structure which requires restraint through 360°, where rock or concrete exists as an anchoring medium. A typical type of such rock bolt is the Split Set® bolt which is sold by International Rollforms, Inc., Deptford, N.J. These bolts have two parts: a tube and a matching domed bearing plate. The tube may be slotted along its length. One tube end is tapered to facilitate insertion into a drill hole in the underground structure, and the other end has a welded ring flange to hold the bearing plate. With the bearing plate in place, the tube is driven into a slightly smaller drill hole to achieve an interference fit and thus hold the rock bolt in place. As the tube portion of the rock bolt slides into place, the full length of the slot narrows causing radial pressure to be exerted against the rock over its full contact length and also provides immediate plate load support.

Split Set rock bolts are typically manufactured by rolling or drawing a flat length of steel to create a circular profile along the length, leaving two ends open and forming an open split over the length. Then one end is cut and tapered over approximately 2 to 3 inches and welded shut while leaving the split open. Then an open-ended ring is welded at the opposite end to act as a retaining device for the bearing plates and assemblies. FIG. 1 is a front view of this type of rock bolt. As illustrated, matched bearing plate 1 and welded-on retaining ring 2 are associated with split hollow tube 3 to form rock bolt 4. Split Set rock bolts are manufactured by International Rollforms, Inc., Deptford, N.J.

Other types of conventional rock bolts include point anchor roof bolts, point anchor resin roof bolts and Swellex™ bolts.

A problem has existed regarding the use of the above-described Split Set, point anchor, point anchor resin, and Swellex rock bolts. After placing the rock bolts in service in the roof or wall rock of the underground structure, water contained in fissures in the rock leaks into the rock bolt and drains through the rock bolt onto the floor of the underground structure. Such drainage results in undesirable wet conditions and can result in corrosion of the rock bolt, the need for pumping accumulated water, increased maintenance of pumps and lines, the need to treat water prior to discharge as well the creation of safety issues. This long standing problem in the art has not been satisfactorily addressed to date. The present invention is believed to address and solve such long standing problem in the art by providing a novel technique and system, rock bolt assembly, and kit for preventing such water leakage. The present invention involves the use of a water-dissolvable sealing unit containing a water-activated expandable hydrophobic pre-polymeric resin. Such sealing unit is contained within the rock bolt and functions to provide a seal against water leakage. Once the rock bolt assembly is in place in an underground structure and is contacted with water, the water dissolvable portion or outer surface of the sealing unit becomes dissolved by the water, which in turn permits the water-activated expandable hydrophobic pre-polymeric resin to react with water and seal both the annular space of the rock bolt assembly and any fissures present in the rock against water leakage. The invention of the present invention may be advantageously utilized in any rock bolt where annular space exists to minimize or seal against water leakage. In the context of the present invention, annular space means the space or open area from the inner diameter of the drilled or pre-formed hole to the outer diameter of the Split Set bolt and at the top, where the sealing unit is located, to the top of the hole.

Other types of rock bolts, in addition to those described above, are known in the art and include those shown in U.S. Patent Publication No. 20040161316 and U.S. Pat. Nos. 4,537,535; 5,249,898; 5,387,060; 6,135,674; 7,073,981; and 7,338,234. The above patent publication and patents do not contain a water-dissolvable sealing unit which contains a water-activated expandable hydrophobic pre-polymeric resin and thus do not function in the above described manner to create a seal against water leakage.

SUMMARY OF THE INVENTION

The present invention involves a sealable rock bolt assembly, a rock bolt assembly kit, and a method for sealing a rock bolt located on the roof, side, or bottom of an underground opening.

More specifically, the sealable rock bolt assembly comprises a bearing plate: an elongated member having a top, bottom, and containing annular space when placed to in a pre-formed hole in the rock to receive expanded resin; and a sealing unit located proximate to the annular space proximate to the rock bolt. The rock bolt may be solid, have a hollow interior, or utilize a cable, such as steel as the support member. The sealing unit comprises a container having sides and two ends and comprised of a water degradable material and having both ends capped with a water degradable material and contains a liquid water activated, expandable hydrophobic pre-polymeric resin. The rock bolt assembly may further comprise a water-containing unit for activation of the liquid water activated, expandable hydrophobic pre-polymeric resin.

The present invention also includes a sealable rock bolt assembly kit containing portions of the rock bolt, prior to assembly, installation, and use, for sealing rock bolts from water leakage comprising a bearing plate; an elongated member having a top, bottom, and containing annular space proximate to the rock bolt when placed in a pre-formed hole in the rock to receive expanded resin; and a sealing unit comprising a container having sides and two ends and comprised of a water degradable material and having both ends capped with a water degradable material, the container containing a liquid water activated, expandable hydrophobic pre-polymeric resin.

The present invention also includes a method for sealing a rock bolt from water leakage comprising: inserting a sealable rock bolt assembly comprising a bearing plate, an elongated member having a top, bottom, and containing annular space when placed in a pre-formed hole in the rock to receive expanded resin; and a sealing unit located proximate to the annular space. The method may also be performed by installing the sealable rock bolt assembly and then installing the sealing unit and any other optional components. The elongated member may have a hollow interior. The to sealing unit comprises a container having sides and two ends and comprised of a water degradable material and having both ends capped with a water degradable material. The container contains a liquid water activated, expandable hydrophobic pre-polymeric resin suitable to be expanded into the pre-formed hole in the rock, which rock contains water. Once the rock bolt is fitted into and secured in a pre-formed hole located in the roof, side or bottom of the rock, water present in the rock, such as in a fissure, contacts the sealing unit to cause the water dissolvable materials to dissolve. Thereby the liquid water activated, expandable hydrophobic pre-polymeric resin is contacted with the water to form an expanded polymeric resin which fills and seals the annular space proximate to the rock bolt, i.e., between the inner diameter of the pre-formed hole and the outer diameter of the rock bolt to the top of the hole, to prevent water flow from the rock through or beside the rock bolt.

The present invention also includes another method embodiment for sealing a rock bolt from water comprising forming an opening that has an open end and a closed end and placing a resin-containing unit at the closed end. A sealable rock bolt assembly is then inserted into the opening. The rock bolt assembly comprises a bearing plate and an elongated member having a top and bottom. Annular space proximate to the rock bolt is created upon insertion of the bolt into the opening. Such insertion causes contact with and puncture of the resin-containing unit by the rock bolt thereby causing the resin to cure and to secure said rock bolt assembly at the closed end of the pre-formed opening. Then a sealing unit is inserted into the opening proximate to its closed end. The sealing unit comprises a container having sides and two ends and comprised of a water degradable material and having both ends capped with a water degradable material. The sealing unit contains a liquid water activated, to expandable hydrophobic pre-polymeric resin. Upon contact of the sealing unit with water, the water dissolvable materials to dissolve; and the liquid water activated, expandable hydrophobic pre-polymeric resin forms an expanded polymeric resin which causes filling and sealing of the annular space proximate to the rock bolt to prevent water flow from the rock through or around the rock bolt. This method embodiment may further include inserting a water-containing unit between the closed end and sealing unit and causing said water-containing unit to release water to activate the resin contained in the sealing unit. Such embodiment may be useful in instances where the opening is dry or does not contain sufficient water to dissolve the outer portions of the sealing unit or to sufficiently expand the resin contained in the sealing unit to achieve the desired seal.

DETAILED DESCRIPTION OF THE INVENTION

The present invention is generally directed to a system and method for preventing the harmful leakage of liquids, such as water, by sealing a rock bolt installed in a roof or side of an underground structure so that the liquid cannot pass through and around the rock bolt and leak into the interior of the underground stricture.

The present invention is also directed to sealable rock bolts that prevent water leakage through the bolt and a kit containing portions of such bolts prior to assembly, installation, and use. The rock bolts are fastened in place in a roof, wall, or bottom of an underground structure via pressure fitting or the like. The rock bolts contain a sealing unit that contains a liquid water activated, expandable hydrophobic pre-polymeric resin. The sealing unit has side, top, and bottom portions that are degradable by water to permit the resin to expand upon contact with water and to seal the annular space formed when the rock bolt is inserted in a pre-formed hole to prevent water passage contained in the roof, wall, or bottom of the underground structure to pass through and or around the bolt and onto the floor of the underground structure.

Figure 1:
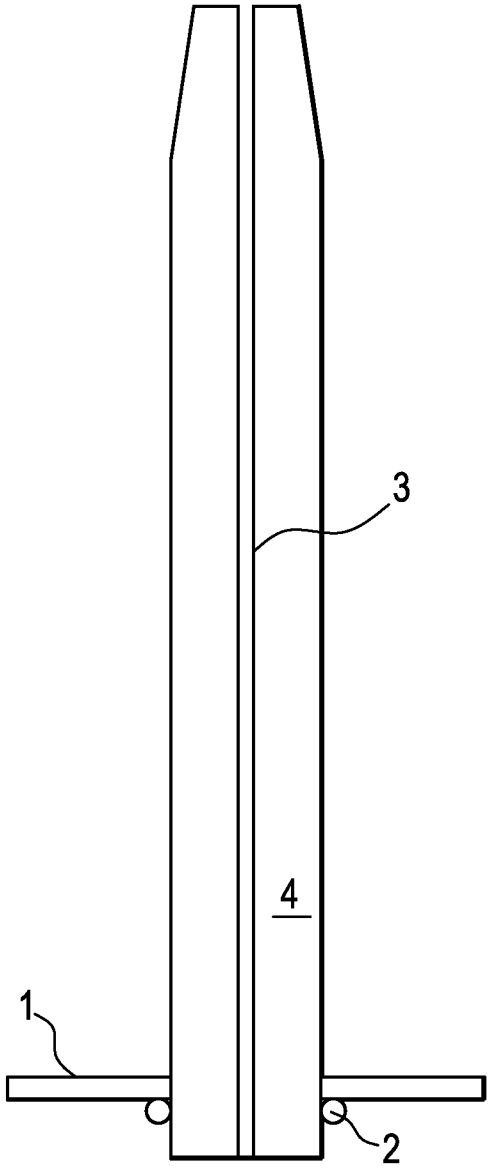
FIG. 1 is a front view of a Split Set type of rock bolt.
Figure 2:
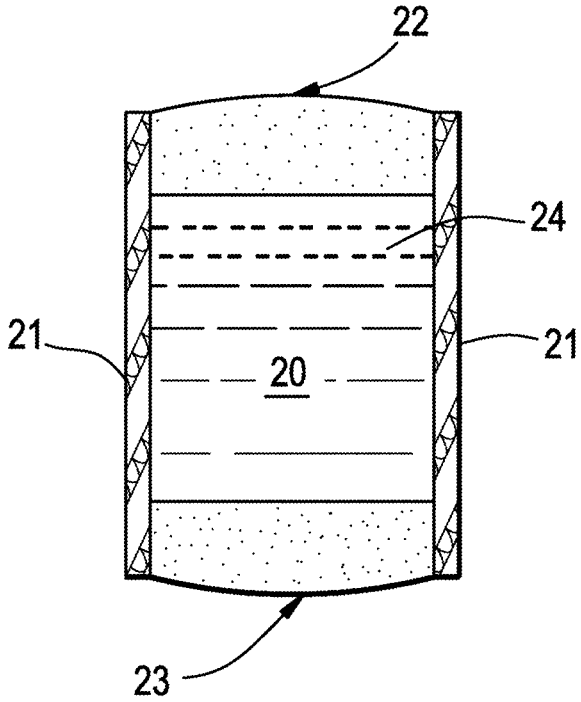
FIG. 2 is a cross-sectional view of a sealing unit to be installed in a rock bolt.

FIG. 2 is a cross-sectional view of a sealing unit that is to be installed into a portion of a rock bolt assembly. Sealing unit 20 is in the form of tube 21 which may be comprised of soap or another water degradable material, such as cellulose, treated cardboard, rice paper, purging paper, sugar, toilet paper or tissue, water soluble to greases, clay (including sandy clay), starch, and water-soluble resins such as thermoplastic or thermosetting resin films. Tube 21 is capped on both ends with salt caps 22 and 23. Other water degradable materials, such as cellulose, treated cardboard, may be used instead of salt. Liquid water activated, expandable hydrophobic pre-polymeric resin 24 is contained within sealing unit 20.

Liquid water-activated, expandable, hydrophobic pre-polymeric resin 20 is capable of expanding to create a semi-flexible foam following contact with water. Hydrophobic polymeric resins, such as polyurethane, repel water during the reactive phase of polymerization and thus are superior to hydrophilic polymeric resins, which entrain water during the reactive phase of polymerization.

Hydrophobic polyurethane resins are well known in the art as grouts used to fill voids and stabilize soils due to their low viscosity, high expansion rate, and ability to set up under wet conditions without diluting. The liquid water activated pre-polymeric resin typically is a one-component system but may be a two-component system. Optional ingredients such as catalysts, reaction accelerators, hydrophobic agents, hydrophobicity inducing surfactants, blowing agents, and other ingredients may be included in the pre-polymeric resins. Low viscosity resins are particularly suitable for use in the invention because such resins are more easily pumped. Typical viscosities range from about 100 Centepoise to about 500 Centepoise.

Suitable hydrophobic polymeric resins include, but are not limited to, polyurethane, polyesters, epoxies, and polyureas. Copolymers of polymeric resins are also contemplated as suitable hydrophobic polymeric resins. Polyurethane hydrophobic resins are preferred due to availability and cost considerations. Moreover, the reactivity profile is easily controlled and a lack of discernable shrinkage occurs following cure.

Hydrophobic polyurethane resins may be made from isocyanate bases, such as tolulene diisocyanate and methylene diisocyanate. A methylene diisocyanate (MDI) base is generally considered to constitute a less hazardous material and thus may be preferred for some applications, such as drinking water applications, where water impairment is to be avoided. The hydrophobic polyurethane foam shown in U.S. Pat. No. 6,747,068 would be suitable for use in the present invention. Other suitable hydrophobic polyurethane resins include Prime-Flex 910 and Prime-Flex 920 supplied by Prime Resins, Inc., Conyers, Ga.; AV-248 Flexseal, AV-275 Soilgrout, and AV-280 Hydrofoam supplied by Avanti International, Webster, Tex.; Mountain Grout® Flexible, SLV, HL-100, and Ultra supplied by Green Mountain International, LLC, Waynesville, N.C.; and Hyperflex supplied by SealGuard, Inc., (a wholly-owned subsidiary of Sub-Technical, Inc.), Mars, Pa.

Once the sealing unit is prepared, the unit is inserted, for example, into the hollow interior of a rock bolt. Following such insertion, a fast reacting polyurethane polymer is pumped into the rock bolt to fill the hollow interior from its bottom to the previously-inserted sealing unit and permitted to react, leaving an open space between the top of the unit and the top of the rock bolt.

Pumping of the polyurethane material may be conveniently accomplished with use of the device illustrated in U.S. Pat. No. 6,955,277. Such patent pertains to a dispensing device and method that is adapted for use in sealing high pressure fluid leaks. The device requires high pressure dispensing of sealant. Suitable sealants are to formed by an exothermic reaction of at least two liquid substances that generate high pressures within the dispensing device. However, high pressures could potentially harm the feeding system of the device due to pressure backflow. This problem is solved by providing a check valve in the mixing and reaction chamber of the device to protect the feeding system. A static mixer is disposed within the chamber to enhance mixing and reaction of the substances. In any event, this device is compatible with the instant invention along with other suitable dispensing devices.

Regarding the fast reacting polyurethane polymer, polymethylene polyphenyl isocyanates and a curing agent, 4,4diphenymethane diisocyanate, are suitable. In addition, all other polyurethanes which produce a rigid closed cell foam may be used in the invention and include, but are not limited to, single component systems such as prepolymeric polyurethanes with a combined catalyst.

Figure 3:
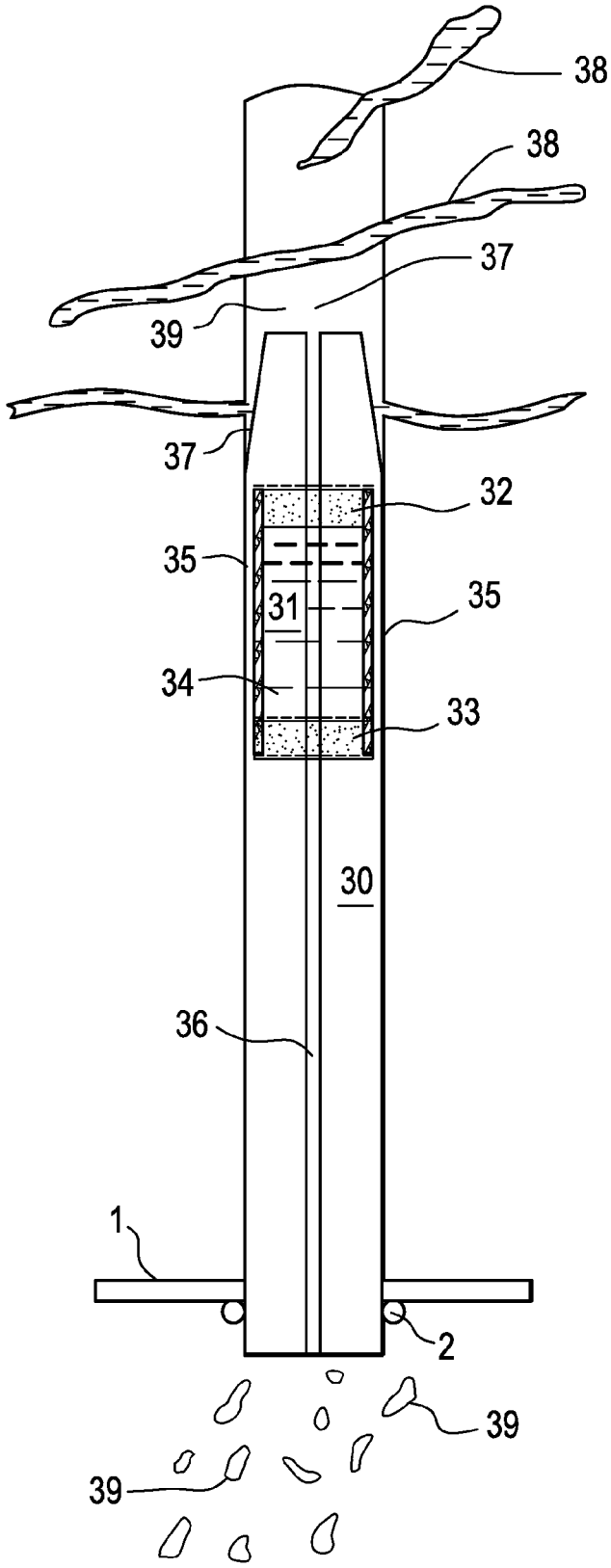
FIG. 3 is a cross-sectional view of a rock bolt assembly that has been installed in a pre-formed hole in an underground structure.

FIG. 3 is a cross-sectional view of a rock bolt assembly that has been installed in a prepared hole in an underground structure. The above-described procedure for making a rock bolt assembly is further illustrated in this Figure. Rock bolt assembly 30 contains sealing unit 31. Sealing unit 31 comprises salt caps 32 and 33 and contains expandable hydrophobic pre-polymeric resin 34 within soap tube 35. Reacted polyurethane polymer 36 is located between the bottom of rock bolt assembly 30 and sealing unit 31. Annular space 37 extends above sealing unit 31 and the top of rock bolt assembly 30. Water-containing fissures 38 and leakage droplets 39 illustrate water leakage from rock bolt assembly 30 prior to sealing. Such water leakage occurs until expandable hydrophobic pre-polymeric resin 34 is caused to expand into and seal annular space 37 at outside diameter rock bolt assembly 30 and at pre-formed opening or hole 39 at the top of rock bolt assembly 30 through contact with water to contained in fissures 38.

Figure 4:
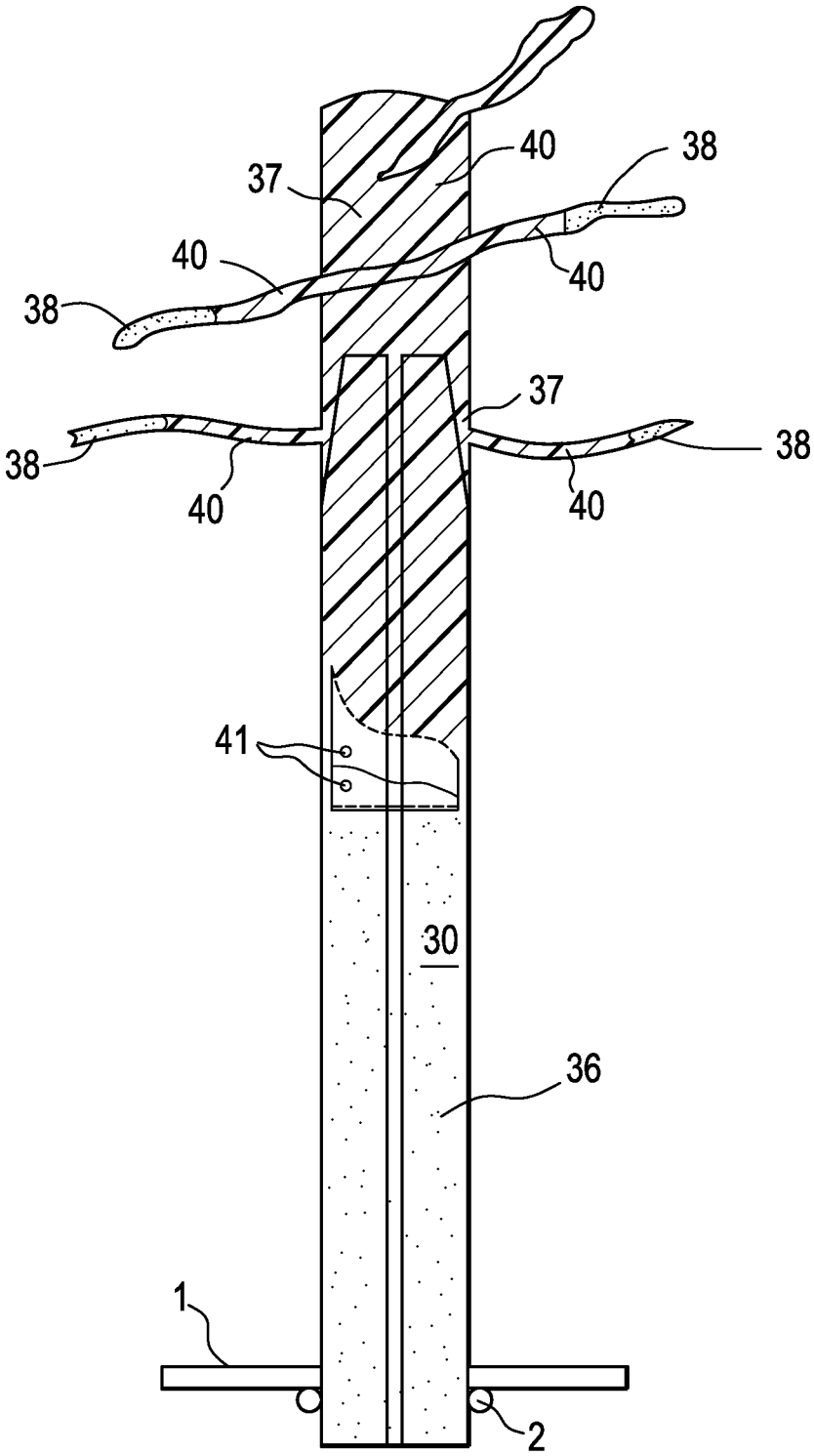
FIG. 4 is a cross-sectional view of a rock bolt assembly that has been installed in a pre-formed hole in an underground structure and then caused to seal the assembly following contact with water contained in the underground structure.

FIG. 4 is a cross-sectional view of rock bolt assembly 30 that has been installed in a prepared hole in an underground structure and then caused to seal the assembly following contact with water contained in the underground structure. This Figure illustrates the result of expansion of expandable hydrophobic pre-polymeric resin 34 (illustrated in FIG. 3) into annular space 37. As may be noted, water has dissolved the soap and salt components of sealing unit 30 at location 41; and rock bolt assembly 30 is now sealed annular space and opening 40 and extends into fissures 38, thereby preventing further water leakage from water-containing fissures 38 into the interior of rock bolt assembly 30.

The addition another unit having water dissolvable sides and ends and containing water, located above the sealing unit for either vertically up and or vertically down holes so that gravity will allow the water contained in the dissolvable unit to flow down over the sealing unit once the contained water dissolves the sides and ends of the water-containing unit and activates the expandable hydrophobic pre-polymeric resin when the container and its ends are dissolved by the released water. Released water from the water-containing unit will activate the expandable hydrophobic pre-polymeric resin even when the hole itself is completely dry. The tube containing the water to be released will remain sealed for approximately 30 minutes to several hours, preferably about 45 minutes, before the water-containing tube will soften and rupture, releasing the water onto the sealing unit, thereby causing the sealing unit to also rupture and release the pre-polymeric resin which will then come into contact with the released water and allow polymerization to occur. The water contained in the tube may optionally contain an activator or catalyst to speed the reaction of the expandable hydrophobic pre-polymeric resin. The water containing unit may be located above the sealing unit whether or not the pre-formed hole is vertically up or down so that the released water may be gravity fed to the sealing unit.

Figure 5:
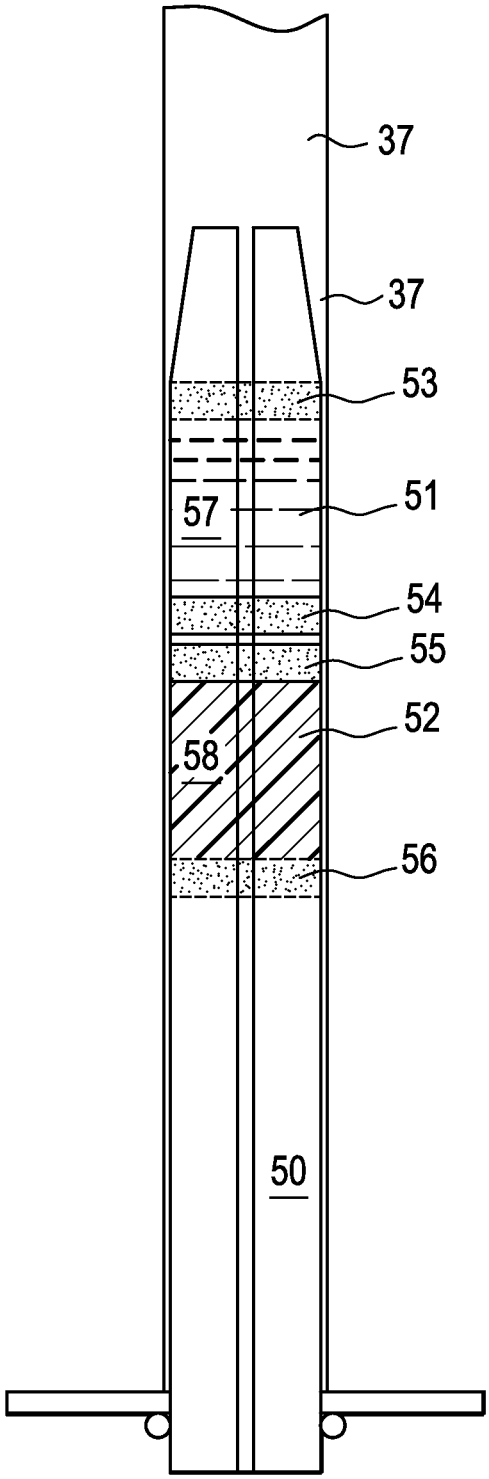
FIG. 5 is a cross-sectional view of a rock bolt assembly having a water-containing unit used to activate a sealing unit.

FIG. 5 is a cross-sectional view of Split Set rock bolt assembly 50 in the vertically up position that includes water-containing unit 51 which is described in the paragraph above and is located above sealing unit 52. In this illustration both units 51 and 52 include salt caps 53, 54 and 55, 56 respectively. Water-containing unit 51 contains water 57 and sealing unit 52 contains expandable hydrophobic pre-polymeric resin 58. Upon activation the expandable hydrophobic pre-polymeric resin expands into annular space 37 and serves to seal rock bolt assemble 50.

The present invention is further illustrated by the following Examples.

Example 1

This Example pertains to the preparation of a sealed rock bolt assembly suitable for use in the method of the invention and comprises the following steps.

1. A sealing unit is prepared by placing a salt cap on one end of a soap tube and then dispensing a liquid water-activated, expandable hydrophobic pre-polymeric resin into the tube and then placing a second salt cap on the opposite end of the soap tube;
2. Inserting the prepared sealing unit inside a hollow Split Set rock bolt toward the tapered end of the rock bolt;
3. Dispensing a heavy bead of a fast reacting polyurethane polymer into the interior of the rock bolt to form a cured foamed reaction product located between the sealing unit and the bottom portion of the rock bolt; and 4. Trimming any excess of foamed material from the rock bolt.

As noted above, this Examples 1, 2, and 3 may be performed by inserting the sealing unit inside the Split Set rock bolt before or after insertion of the rock bolt prior to or following placement of the rock bolt into a pre-formed hole or opening.

Example 2

This example pertains to the installation of a rock bolt assembly into rock of an to underground structure and comprises the following steps.

1. A hole of suitable diameter and length is drilled into rock;
2. Inserting a chuck protrusion into the upper end of the rock bolt assembly and fitting bearing plates onto the assembly; and
3. Engaging the rock bolt assembly into the drilled hole and, using the drill head, hammering the rock bolt assembly into the hole until it is fully inserted. The rock bolt assembly will become secured in the drilled hole due to an interference fit. Once the rock bolt assembly is in place, the unit is upon contact with water in the manner described above, i.e., the soap and salt will be dissolved by the water, which in turn will permit the water-activated expandable hydrophobic pre-polymeric resin to react with water and seal both the annular space of the rock bolt assembly and any fissures present in the rock.

Example 3

After a Split Set roof bolt has been installed in the rock, the bolt can be waterproofed by the following method. First, prepare a soap tube unit with a water activated, expandable hydrophobic pre-polymeric and also a unit containing water. Then both units are slid up the center of the Split Set bolt and secured at the top of the bolt with use of a plug, such as balled rag or burlap. Then take a tube of our two component rigid foam, enter the nozzle of the tube into the opening of the Split Set bolt and seal around the opening with a rag or burlap, then dispense resin from the to tube to refusal (the resinous material has a 3+ second reaction time). Once finished, the nozzle and rag or burlap are removed. This procedure then waterproofs a Split Set bolt in-situ. The rigid foam induced into the bottom portion of the Split Set bolt will, depending upon its density, increase the pull out force required. Also of course the force required to insert the bolt will be higher. Having a higher pull out strength is an advantage in ground control.

Although the above Examples pertain to Split Set rock bolts, those skilled in the art would understand that the principles underlying the present invention are generally applicable for any rock bolt where annular space proximate to an inserted rock bolt exists to minimize or seal against water leakage, including other types of conventional rock bolts such as point anchor roof bolts, point anchor resin roof bolts and Swellex bolts. Accordingly, the rock bolts of the invention may be solid, have a hollow interior, or utilize a cable, such as steel, as the support member.

When a solid or cable rock bolt is installed in a roof or the like, a resin-containing unit or cartridge, such as a polyester-containing unit, is first inserted at the top of the pre-formed hole. This serves as the primary anchor for the bolt end. The bolt is then pushed up into the hole and punctures the film surrounding the cartridge. The solid or cable bolt is then spun to mix the resin and then the bolt is held in place once the resin becomes set. In the present invention, an additional cartridge or sealing unit, such as that described in connection with FIG. 2, is placed in the pre-formed hole following placement of the resin-containing cartridge. Then as the bolt is inserted into the hole, it will puncture the sealing unit, release the contained expandable hydrophobic pre-polymeric resin located underneath the resin-containing cartridge, continue up the hole to puncture the resin-containing cartridge, and then spin the resin to establish bolt anchoring. Once the sealing unit is punctured, the released resin will migrate or flow down the length of the hole and sides of the bolt and react with water to seal the bolt from subsequent water leakage. Should the hole be dry when the above procedure is performed, a water-containing unit, such as described in connection with FIG. 5, can be employed. In such instance, the resin-containing unit is inserted, followed by the water-containing unit, and finally by the sealing unit. Such arrangement permits water to flow downwardly and activate the resin contained in the sealing unit.

Point anchor bolts utilize a split wedge type retainer included with the bolt on the opposite end to the head of the bolt. A hole is drilled into the rock and the bolt inserted. The retainer grips the inside of the hole and, as the bolt is rotated, the retainer expands to the inside of the hole and simultaneously draws the bolt tight between the anchor point and the head of the bolt on the outside of the hole. This to procedure secures the bolt to a specified torque value. Point anchor bolts are manufactured by Jennmar Corporation, Pittsburgh, Pa. The present invention can be used for point anchor roof bolts by placing a sealing unit and a water-containing unit ahead of the bolt, so that when the bolt is pushed into the hole, the units rupture and water and the water-activated expandable hydrophobic pre-polymeric resin react and the expanded resin fills the annular region surrounding the bolt. This procedure serves to protect all of the bolt and its mechanism from corrosion and serves to waterproof the bolt. Optionally a rubber washer may be included between the bearing plate and roof, sidewall, or floor tom seal from potential water dripping.

Point anchor rock bolts are quite similar to conventional point anchor rock bolts. Such bolts are manufactured by Jennmar Corporation, Pittsburgh, Pa., and a typical point anchor resin rock bolt of Jennmar Corporation is illustrated in U.S. Pat. No. 7,073,982. During installation of the bolt, a hole is drilled and a single resin-containing unit in the form of a cartridge is pushed into the hole ahead of the bolt. As the cartridge reaches depth, the cartridge ruptures and as it rotates and the resin and hardener are mixed and form a cured resin around the head of the bolt. The roof bolt is held in place for several seconds so that the resin can react and cure. In using the present invention for a point anchor rock bolt, a sealing unit is pushed behind the resin cartridge and ruptured first by the sharp leading end of the rock bolt or cable bolt while then continuing to mix the resin and secure the end of the bolt. This procedure permits the water-activated expandable hydrophobic pre-polymeric resin to react and the expanded resin to seal the annular space proximate to the rock bolt.

Swellex bolts are manufactured from a steel tube and are sealed at one end and have a threaded pressure connection at the head end. This type of bolt is inserted into a pre-drilled hole and secured in place when a high pressure water pump is connected to the exposed end and pressure applied. Such procedure causes the bolt to swell inside the hole and tightly conform to the inside of the hole over the entire length. A bearing plate similar to that of the other above-described bolts is included in the assembly. Swellex bolts are manufactured by Atlas Copco, through Minova Americas, Georgetown, Ky. The present invention may be used for Swellex bolts by inserting a sealing unit, followed by the bolt into a pre-drilled hole. The sealing unit would then be ruptured thus permitting the water-activated expandable hydrophobic pre-polymeric resin to react with water and fill and seal the annular space. A water-containing unit may be used to supply water as needed.

It should be further noted that liquid water activated, expandable hydrophobic pre-polymeric resin may be applied to the surface of cable bolts and all other types of rock bolts and then the bolt be inserted into the roof, bottom, or wall. The resin will expand to seal the annular space proximate to the roof bolt and surround the bolt, thus protecting it from corrosion. In addition this embodiment will serve to somewhat increase the holding power of the bolt.

It is claimed:

1. A sealable rock bolt assembly comprising a bearing plate: an elongated member having a top, bottom, and containing annular space proximate to said bolt assembly when said assembly is placed in a pre-formed hole to receive expanded resin; and a sealing unit located proximate to said annular space around said rock bolt, said sealing unit comprising a container having sides and two ends and comprised of a water degradable material and having both ends capped with a water degradable material, said container containing a liquid water activated, expandable hydrophobic pre-polymeric resin.

2. The sealable rock bolt assembly of claim 1 wherein said elongated member has a hollow interior.

3. The rock bolt assembly of claim 1 wherein said water degradable material of said sides of said sealing unit comprises soap.

4. The rock bolt assembly of claim 1 wherein said water degradable material of at least one of said ends comprises salt.

5. The rock bolt assembly of claim 1 further comprising a water-containing unit.

6. The rock bolt assembly of claim 1 wherein said liquid water activated, expandable hydrophobic pre-polymeric resin is a member selected from the group consisting of polyurethane resins, polyester resins, epoxy resins, and polyurea resins.

7. A kit for assembling a sealable rock bolt from water comprising:

(a) a bearing plate;

(b) an elongated member having a top, bottom, and containing annular space proximate to said rock bolt when said rock bolt is placed in a pre-formed hole to receive expanded resin; and (c) a sealing unit comprising a container having sides and two ends and comprised of a water degradable material and having both ends capped with a water degradable material, said container containing a liquid water activated, expandable hydrophobic pre-polymeric resin.

8. The kit of claim 7 wherein said elongated member has a hollow interior.

9. A method for sealing a rock bolt from water comprising:

(a) inserting a sealable rock bolt assembly into a pre-formed hole, said rock bolt assembly comprising a bearing plate: an elongated member having a top and bottom and containing annular space proximate to said rock bolt when said rock bolt placed in a pre-formed hole; and placing a sealing unit located proximate to said annular space into said rock bolt assembly, said sealing unit comprising a container having sides and two ends and comprised of a water degradable material and having both ends capped with a water degradable material, said container containing a liquid water activated, expandable hydrophobic pre-polymeric resin into a pre-formed hole in a rock, said rock containing water;

(b) contacting said sealing unit with water to cause said water degradable materials to dissolve; and (c) contacting said liquid water activated, expandable hydrophobic pre-polymeric resin to form an expanded polymeric resin filling and sealing said annular space proximate to said rock bolt to prevent water flow from said rock through said elongated member.

10. The method of claim 9 wherein said elongated member has a hollow interior.

11. The method of claim 9, wherein said sealing unit is contacted with water from said rock to cause said side and ends of said sealing unit to dissolve and to cause said liquid water activated, expandable hydrophobic pre-polymeric resin to form an expanded polymeric resin filling and sealing said annular space to prevent water flow from said rock through said hollow elongated member.

12. The method of claim 9, wherein said sealing unit is contacted with water from a water-containing unit having water dissolvable sides and ends and located within said rock bolt assembly to cause said side and ends of said sealing unit to dissolve and to cause said liquid water activated, expandable hydrophobic pre-polymeric resin to form an expanded polymeric resin filling and sealing said annular space to prevent water flow from said rock through said hollow elongated member.

13. The method of claim 9 wherein said sealing unit is contacted with water from a water-containing fissure in said rock.

14. The method of claim 9 further comprising injecting a fast reacting polyurethane polymer into said rock bolt assembly to fill said hollow interior from its bottom to the previously-inserted sealing unit and permitting aid polymer to react, leaving an open space between the top of the unit and the top of the rock bolt.

15. The method of claim 9, wherein said sealing unit is placed into said rock bolt assembly before inserting said rock bolt assembly into said pre-formed hole.

16. The method of claim 9, wherein said sealing unit is placed into said rock bolt assembly after inserting said rock bolt assembly into said pre-formed hole.

17. A method for sealing a rock bolt from water comprising:

(a) forming an opening in rock, said opening having an open end and a closed end and a resin-containing unit located at said closed end;

(b) inserting a sealable rock bolt assembly into said opening, said rock bolt assembly comprising a bearing plate and an elongated member having a top and bottom and creating annular space proximate to said rock bolt upon being placed in said opening, said insertion contacting and puncturing said resin-containing unit to cause said resin to become cured and to secure said rock bolt assembly at said closed end;

(c) inserting a sealing unit located proximate to said closed end of said opening into said opening, said sealing unit comprising a container having sides and two ends and comprised of a water degradable material and having both ends capped with a water degradable material, said container containing a liquid water activated, expandable hydrophobic pre-polymeric resin;

(d) contacting said sealing unit with water to cause said water dissolvable materials to dissolve; and (e) contacting said liquid water activated, expandable hydrophobic pre-polymeric resin with water to form an expanded polymeric resin which causes filling and sealing of said annular space proximate to said rock bolt to prevent water flow from said rock through said elongated member.

18. The method of claim 17 further comprising inserting a water-containing unit between said closed end of aid opening and said sealing unit and causing said water-containing unit to release water to activate and expand said pre-polymeric resin.

* * * * *